US006575391B1

(12) United States Patent
Brown, Jr. et al.

(10) Patent No.: US 6,575,391 B1
(45) Date of Patent: Jun. 10, 2003

(54) MILL WITH QUICK CHANGE, UNITIZED, DYNAMIC ELEMENTS

(76) Inventors: Charles Kepler Brown, Jr., 8317 Robert Bruce Dr., Richmond, VA (US) 23235; David Kepler Brown, 3327 Grove Ave., Apt. 6, Richmond, VA (US) 23221

( * ) Notice: Subject to any disclaimer, the term of this patent is extended or adjusted under 35 U.S.C. 154(b) by 0 days.

(21) Appl. No.: 09/784,447

(22) PCT Filed: Aug. 26, 1999

(86) PCT No.: PCT/US99/19504

§ 371 (c)(1),
(2), (4) Date: Apr. 23, 2001

(87) PCT Pub. No.: WO00/12217

PCT Pub. Date: Mar. 9, 2000

Related U.S. Application Data

(60) Provisional application No. 60/098,009, filed on Aug. 26, 1998.

(51) Int. Cl.[7] ..... B02C 18/12

(52) U.S. Cl. ..... 241/60; 241/253; 241/259

(58) Field of Search ..... 241/57, 60, 253, 241/188.1, 154, 259, 251, 261.2, 261.3

(56) References Cited

U.S. PATENT DOCUMENTS

| | | | |
|---|---|---|---|
| 1,221,952 | A | 4/1917 | Adams |
| 2,328,950 | A | 9/1943 | Brant |
| 4,196,224 | A | 4/1980 | Falk |
| 5,836,523 | A | 11/1998 | Johnson |

*Primary Examiner*—Mark Rosenbaum
(74) *Attorney, Agent, or Firm*—Jacobson Holman PLLC

(57) ABSTRACT

A mill with capability for rapid replacement of wearable moving components and capacity for precision grinding movement. The wearable moving components form a package of dual counter-rotating rotor centrifugal devices, the packages including first and second motors (2, 5), counter-rotating first and second rotors (1, 4) driven by the first and second motors, respectively, a hollow shaft (6) connecting the first to the first rotor, and a solid shaft (3) connecting the second motor to the second rotor, the solid shaft running inside the hollow shaft.

15 Claims, 7 Drawing Sheets

MILL WITH QUICK CHANGE, UNITIZED, DYNAMIC ELEMENTS

CROSS-REFERENCE TO RELATED APPLICATIONS

The present patent application is based on, and claims priority from, U.S. provisional Application No. 60/098,009, filed Aug. 26, 1998, which is incorporated herein by reference in its entirety.

BACKGROUND OF THE INVENTION

1. Field of the Invention

The present invention relates to mills for pulverizing coal and other fuels, and in particular, to mills in which the dynamic or operating elements are assembled to form a compact, unitized package that can quickly and easily be slipped into and out of the basic mill structure.

2. Related Art

The prior art contains multifarious instances of dual counter-rotating rotor mills (with dual shafts and drives) but exhibiting no features for rapid or easy disassembly, which is desirable for economic reasons. In this category fall Evans (2,361,278), Meger et al (3,047,343), Noe (3,411,724), Hint (3,497,144), Smith (3,817,460), Benedikter (3,894,695), Brown (4,355,586), and Muschenborn et al (4,522,342).

Even in the case of an earlier Benedikter patent (3,823,919) concerned with solving the problem of readily removing buildups of process material from interior mill surfaces, the concept is to transport the buildup out of the mill rather than to effect economic disassembly or replacement of critical components. Parmele (3,317,975) approaches the problem by removing one rotor from the other by means of a trolley. That type of solution nevertheless requires loss of operating time. The present invention provides significant economic advantages to mill owners such as utilities for whom large dollar benefits can result from avoiding unplanned downtime otherwise occurring with mills inherently impossible to service fully with rapidity.

The invention depends on a shaft-within-shaft drive arrangement. Durek (4,406,409) employs two hollow shafts riding on a common fixed shaft. Pallmann (3,549,093) use a shaft-within-shaft arrangement. Neither of these, however, offers any component replacement economies.

SUMMARY OF THE INVENTION

An object of this invention is to improve the size reduction technology for coal, minerals (including ores, compounds, and elements), biomass waste, and other materials.

A further object of this invention is to provide efficient means for quickly returning service-critical mills to full service by replacing one unitized package (or module) containing both milling components and drive motors.

Another object of the invention is to provide capability to service worn milling components with activity that does not interrupt mill production time.

It is yet another object of this invention to improve the technology of grinding, such as with coal fuel of micronic size particles that can be burned much like oil or gas in boilers using air to blow fuel to burners for combustion, substantially reducing nitrous oxide emissions due to small, average coal particle sizes.

Current technology for utility coal grinding generally employs rollers or balls to crush coal in a rotating bowl. Coal feeds in at a controlled rate; and powdered product coal is removed by passing high velocity air through the mill and picking up coal fines as they pass from the rolling zone. Generally, the stream of air bearing the coal dust passes through a classifier that separates out oversize particles and sends them back through the rolling zone for further grinding. By necessity these mills are heavily built to withstand the heavy forces applied.

Maintenance in these bowl mills is expensive, and breakdowns or even planned maintenance is time-consuming. Mills can be down for days or even weeks. The mill in accordance with the present invention is totally different in concept. It depends on high velocity impacting and abrasion created by the use of high speed multiple-ring rotors that are juxtaposed face to face such that process material is thrown by centrifugal force from the rings of one rotor to the rings or the other (counter-rotating) rotor. From the resulting labyrinthine passages, process material exits the rotor set reduced to a very fine state. Various configurations of ring structures produce different fineness levels of reduction. Some of these constructions are subjects of other patent applications.

In the present invention, the use of speed to impart destructive forces in the reduction process, rather than force applied by heavy elements, permits the use of lighter structure that can be configured into a simpler and more compact unit. The motors are directly coupled to their respective rotor assemblies. There are no heavy gearboxes necessary for reducing high motor speeds to slow bowl or roller rotating speeds. The other attendant structures can be either eliminated or lightened in weight considerably and arranged for rapid replacement.

The present invention provides large economic advantages for mill owners like utilities for which large dollar benefits or penalties can result from unplanned downtime with mills inherently impossible to service fully with rapidity.

Other objects, features, and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
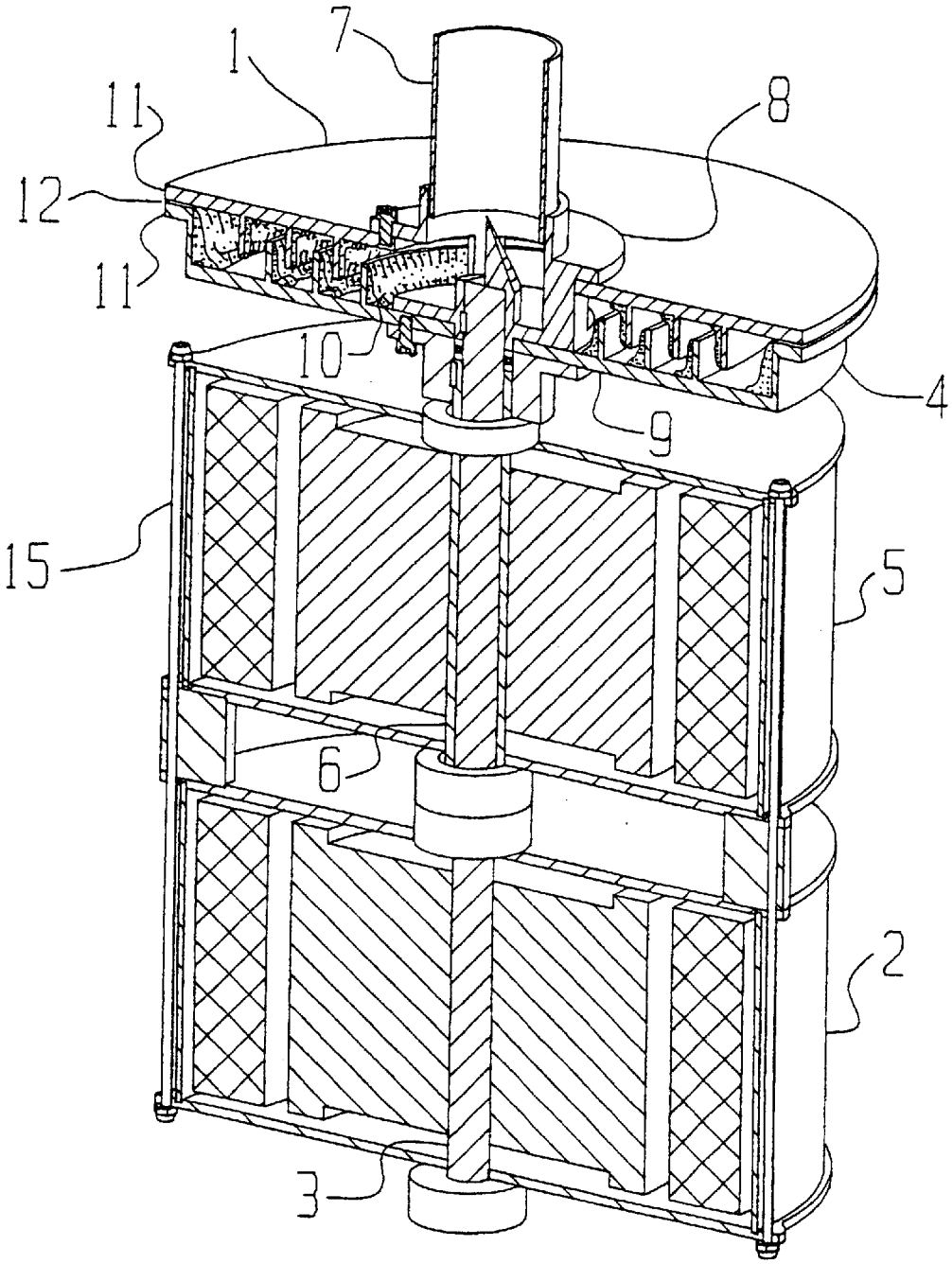
FIG. 1 is a perspective view, partially in cross-section, of unitized milling and drive components of one embodiment of the invention, with center feed pipe added.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

FIG. 1 shows the dynamic or operating elements of a mill, in accordance with the present invention, which dynamic or operating elements are assembled to form a compact, unitized package 15. The unitized package 15 includes an upper rotor 1 driven by a lower motor 2 through a solid shaft 3, and a lower rotor 4 driven by an upper motor 5 through a hollow shaft 6.

The upper and lower rotors 1 and 4 are driven in opposite directions and form a counter-rotating rotor system. The rotors 1 and 4 are high speed multiple-ring rotors that are juxtaposed face to face such that process material is thrown by centrifugal force from the rings of one rotor to the rings of the other (counter-rotating) rotor. From the resulting labyrinthine passages, process material exits the rotor set reduced to a very fine state. Various configurations of ring structures produce different fineness levels of reduction. The various configurations are described more fully in U.S. Pat. No. 5,597,127 to Brown, a co-inventor of the present invention, and in our co-pending U.S. patent application No. 09/302,359, filed Apr. 30, 1999, both of which are incorporated herein by reference in their entireties.

Raw coal feeds through feed pipe 7 and special hub 8. The hub 8 has spoke-like elements 9 with openings 10 for the coal to move under centrifugal force into the counter rotating rotor system.

The primary object of the mill is to reduce coal or other materials into particle sizes wherein a high percentage of, for example, coal is reduced to about 98% smaller than retained by a screen size of 100 mesh per inch for improved fuel efficiency and reduced emissions of nitrous oxides. Rather than using relatively complex classifier and re-circulating devices to return oversize material back for additional grinding, the oversize from this mill can be controlled by a simple Go-No-Go gauge process. The outer rings 11 at the periphery of the rotors 1 and 4 can provide a gap 12 that only passes specification size particles and will crush oversize particles, a fraction of the total flow.

As can readily be seen in FIGS. 2–5, this construction results in a very compact package that can be slipped into and out of a plenum structure 17 with a hydraulically-operated lift mechanism 14, such as a fork-type lift, and locked into place with hydraulically operated devices 23 such as bolts or wedges. A hydraulic mechanism is preferable because of its ease of operation but other mechanical or electrical means could be used. Electrical connections or lubrication connections can be so arranged that they will connect and disconnect automatically as the rotor and motor drive packages are moved into and out of working position. With this set-up, it is only a matter of pushing a few control buttons operatively connected to the hydraulic lift mechanism 14. With hydraulics doing all of the work a mill should never be down more than a few minutes, not days or even weeks as it is with most conventional mills. Power plant downtime is very costly.

Figure 2:
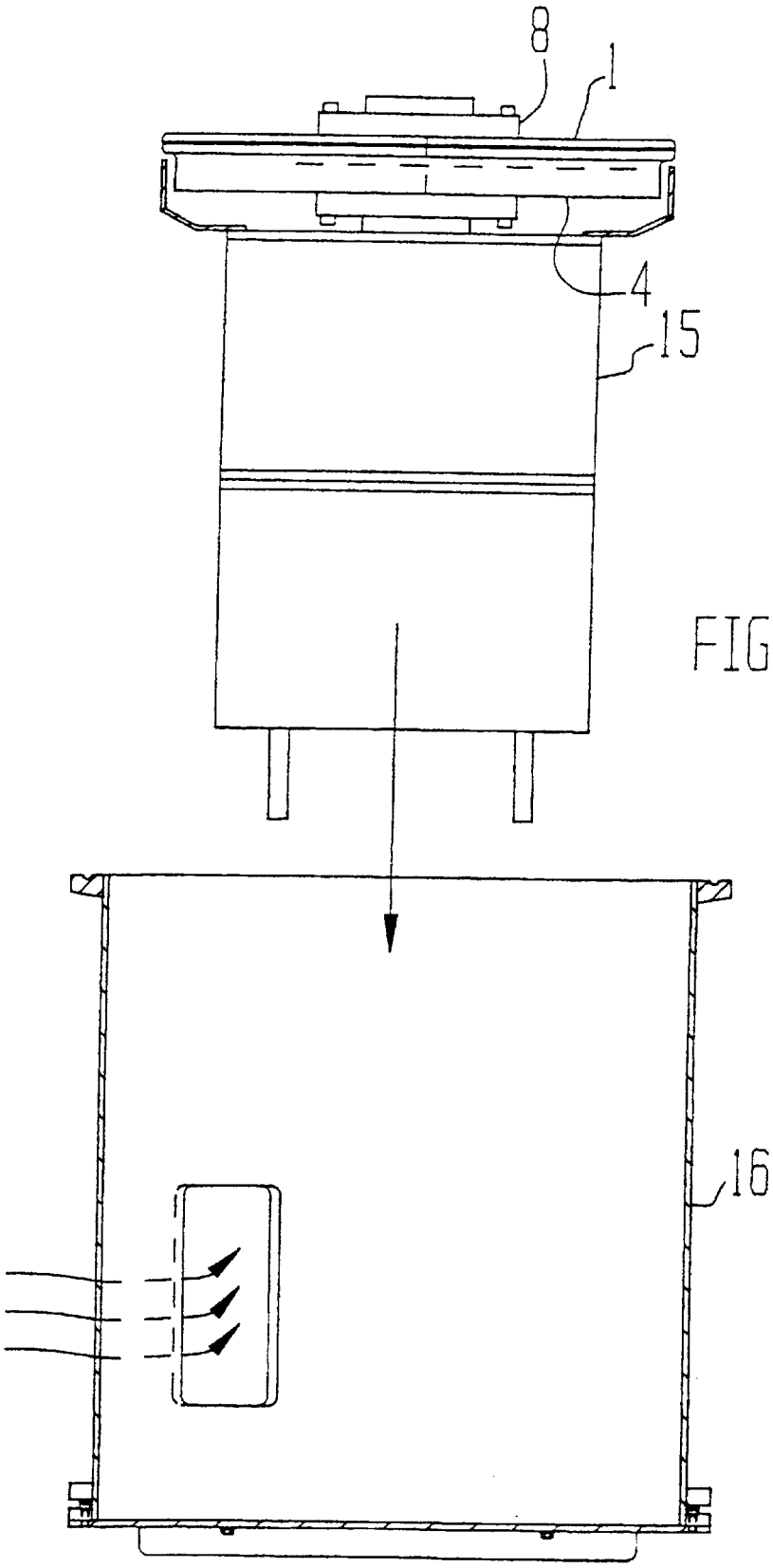
FIG. 2 is an exploded, elevational view, partially in cross-section, of the unitized components of FIG. 1 and a canister in which the unitized components are housed for handling and, in one embodiment, providing structure for containing and conveying transport air.
Figure 3:
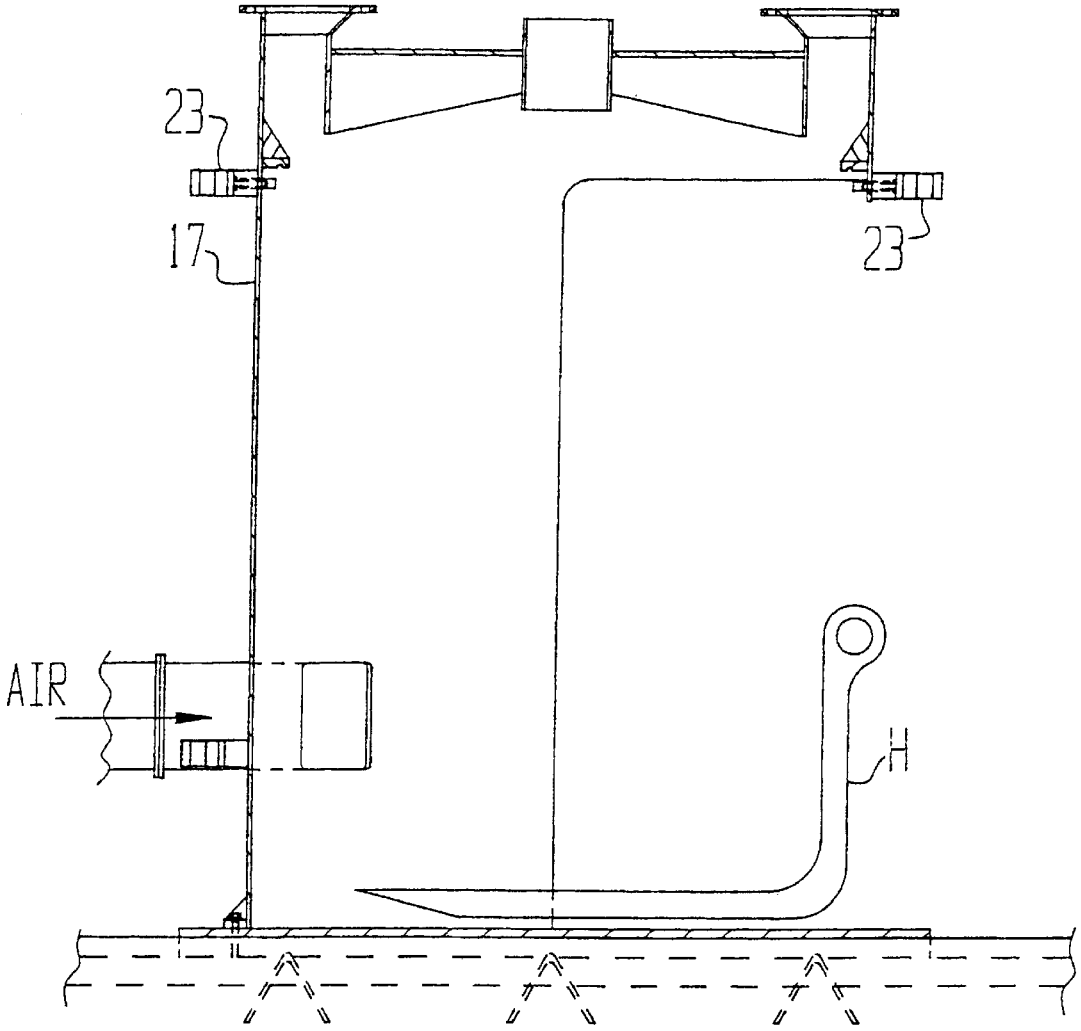
FIG. 3 is an elevational view, partially in cross-section, of structure for coupling the unitized canister together with incoming air ductwork, motor coolant, and electricity, and outgoing plenums for air transport of product fines, as well as for connection to feedstock fee piping.
Figure 4:
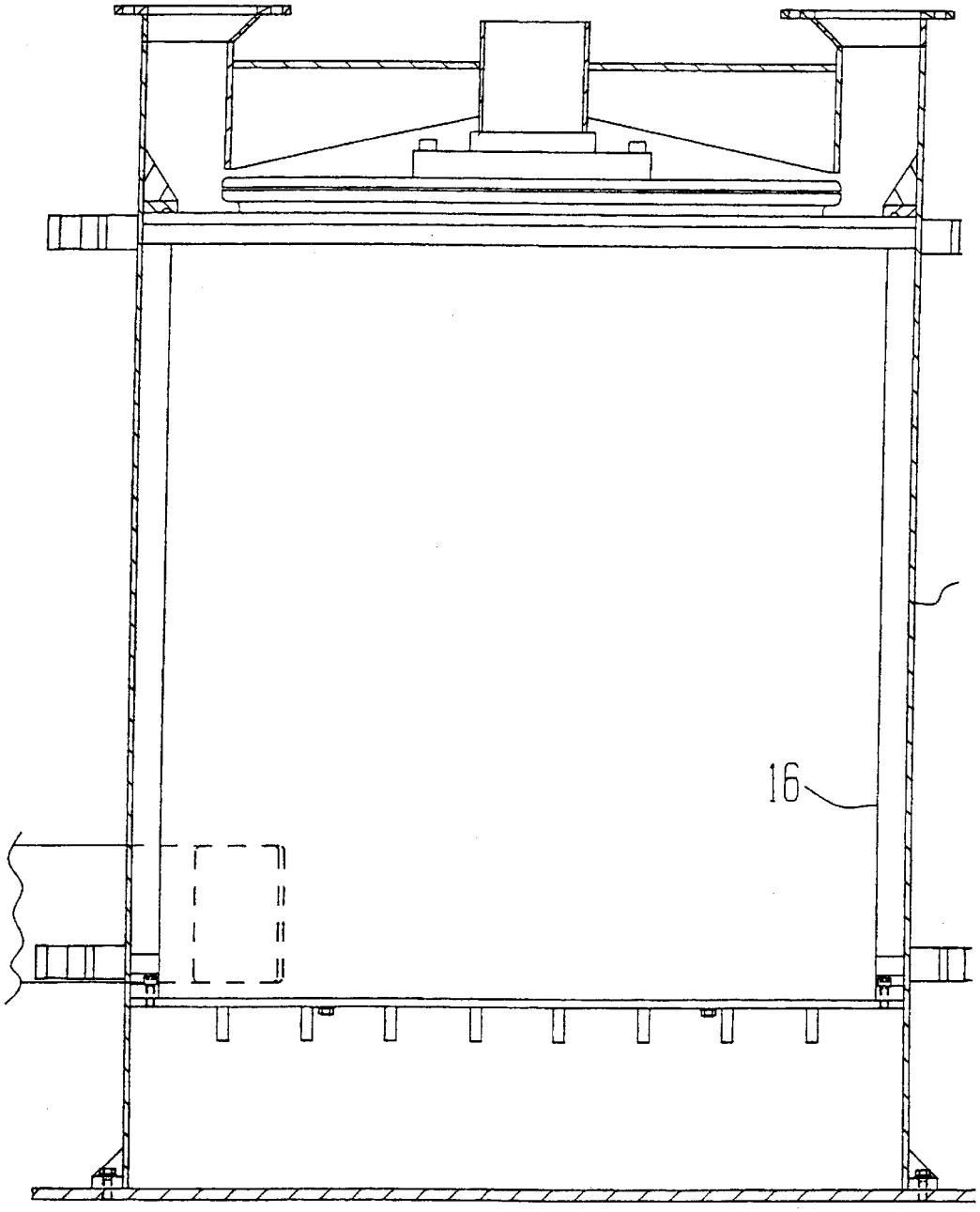
FIG. 4 is an elevational view of the unitized canister raised into position in the plenum structure and locked in place.
Figure 5:
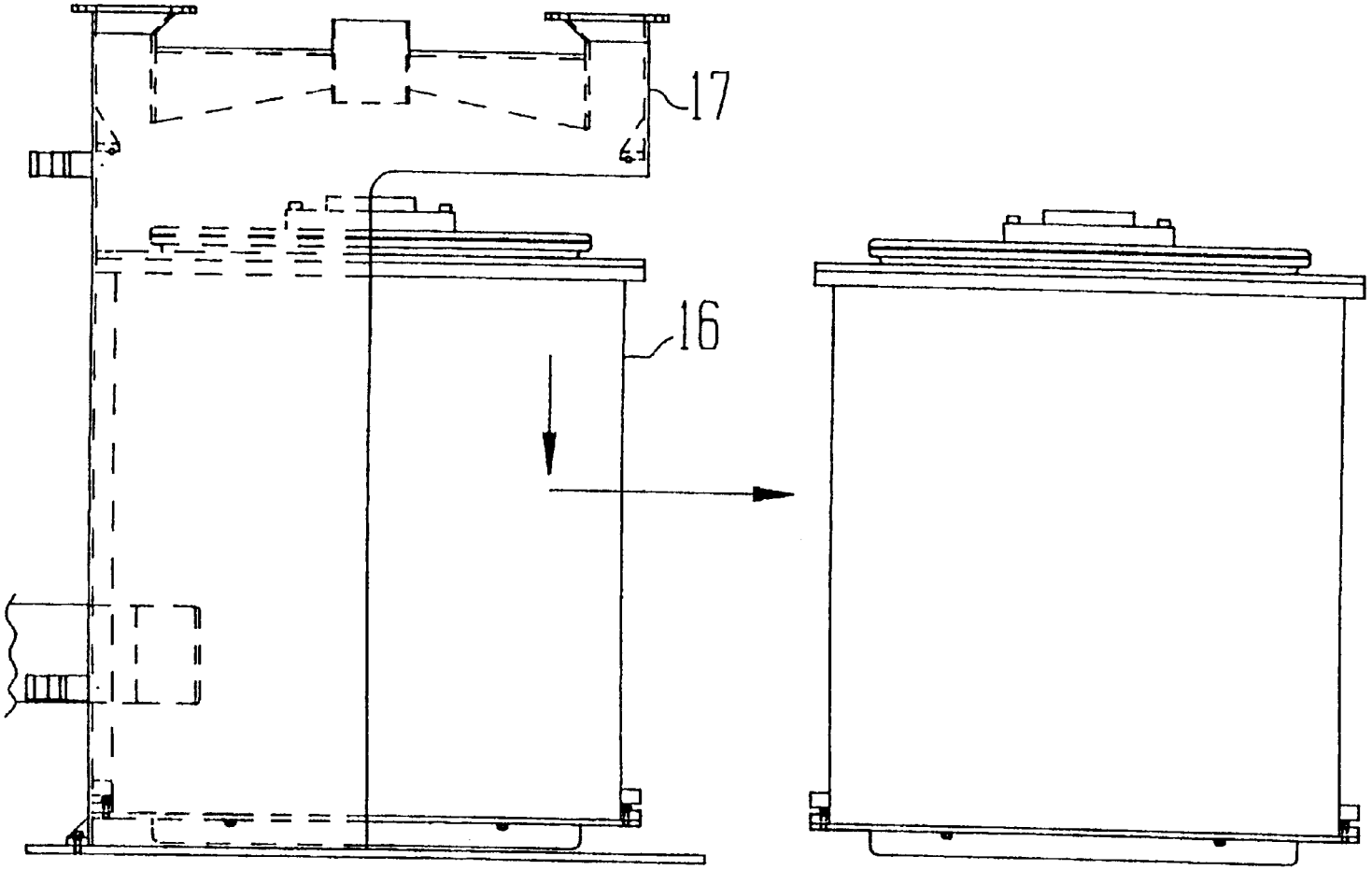
FIG. 5 is an elevational view of the unitized canister moved down and laterally away from the plenum structure that connects to feedstock, air, and product ducts.

The dynamic package 15 as seen in FIG. 1 is assembled into the canister 16 as seen in FIG. 2. The completed assembly of the dynamic package 15 and the canister 16 is seen installed in a plenum structure 17 as is shown in FIG. 4. This package can be dropped down out of the plenum structure 17, as shown in FIG. 5, and carried to a work area where repairs can be made at a leisurely pace. The repaired package or an identical subassembly can be mounted into the plenum structure 17 in place of a defective unit, as seen assembled in FIG. 4.

Air in sufficient volume and velocity has to be passed through the mill while in operation to transport the product out of the mill. In utility boiler mills, this transport air is called primary air. At the burners air is added in sufficient volume to maintain the best fuel-air ratios for different levels of fuel consumption In the embodiment shown in FIG. 6, the fuel and air leaving the mill are conducted through ducts 93 connected to the plenum structure 17 at surfaces 22. Incoming coal enters the mill through feed pipe 7. All coal, air, and product connections are airtight. Sealing of canister 16 to plenum structure 17 is done with annular seal rings 80. Air can be supplied by auxiliary internal or external fans or blowers. The coal is fed in through air lock devices, where necessary. The air-fuel mixture exits the system at the burners.

Figure 6:
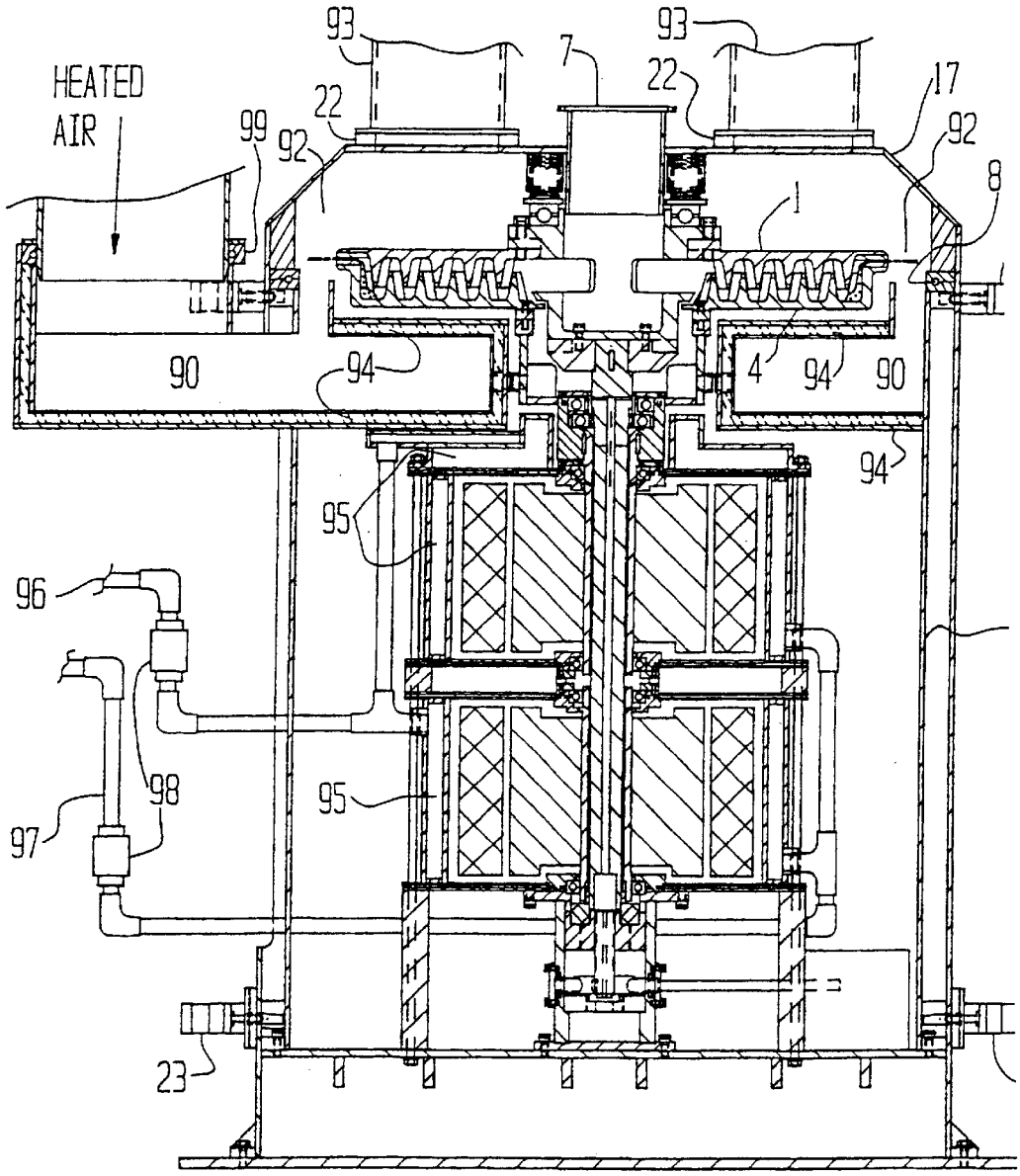
FIG. 6 is a cross-sectional view of yet another embodiment for utility service in which transport air is pre-heated and motors are liquid-cooled.

The embodiment shown in FIG. 6 is capable of utilizing heated primary air for transporting milled coal from the micronizer to boiler burners. The canister 16 is equipped with an annular scroll 90, into which heated transport air is conducted through a quick connection joint 99. The scroll 90 is provided along its inner walls with insulation 94 for protecting the drive motors 2 and 5 from the heated transport air. The heated transport air moves from the scroll 90 into and through a communicating annular passage 92 surrounding the rotors 1 and 4. Milled coal exiting the rotors 1 and 4 through the gap 12 is entrained in the annular passage 92 by the heated transport air, and is carried through ducts 93 to a boiler.

Motor coolant is conducted into motor cooling jackets 95 surrounding motors 2 and 5 through input lines 96 and warmed motor coolant is conducted away from the motors 2 and 5 through an exit line 97. Quick disconnect joints 98 are provided at the ends of lines 96 and 97 for speeding replacement of module 17.

Figure 7:
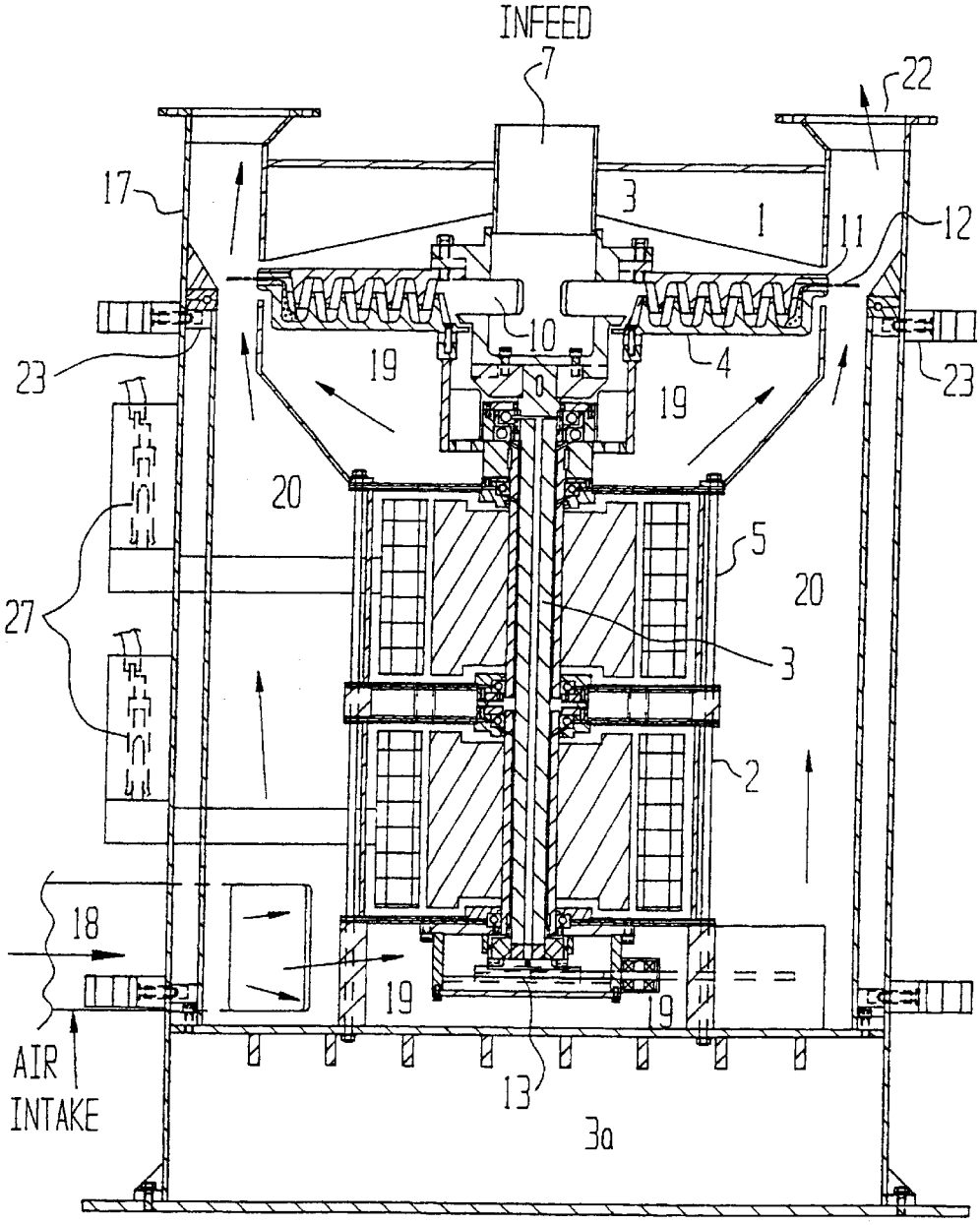
FIG. 7 is a cross-sectional view of an embodiment showing the canister coupled with the plenum structure, and product transport air used for motor cooling, for applications in which pre-heated transport air is not required.

Although not shown in FIG. 6, spade-type electrical connections 27 provide power to the motors 2 and 5 as in the embodiment shown in FIG. 7.

In another embodiment, shown in FIG. 7, motor-cooling air can also serve as product transport air. This embodiment may be preferable in coal preparation plants. The canister 16 is equipped with connections to the plenum structure 17 for admitting incoming airflow 18. The incoming airflow 18 splits into two paths 19 and 20. Path 19 passes air through the motors for cooling. Path 20 passes around the motors 2 and 5, then upwards and around the rotors 1 and 4 to join with path 19 to entrain milled coal exiting through the gap 12 at the outer rings of the rotors 1 and 4. Spade-type electrical connectors 27 provide power to the motors 2 and 5.

In the embodiments of both of FIGS. 6 and 7, the concentric shafts 3 and 6 and the counter-rotating rotors 1 and 4 in accordance with the present invention permit precision control of spacing between the rotors 1 and 4. This precision capability is used to maintain low tolerance gaps 12 between the outermost rings 11 of the rotors 1 and 4, so that only process material that is within specification can pass out of the rotor set. A precision gap 12 between the rotors 1 and 4 is varied by axial movement of the inner shaft 3, by an adjustment means comprising a worm and nut mechanism 13 on the lower end of the shaft 3. To allow this movement, the solid shaft 3 is fitted with a spline section, which engages a mating spline in the interior of a hollow shaft 3*a* fixed to the armature of the lower motor 2 and surrounding the solid shaft 3*a*. The gap adjustment can be made manually or automatically while the mill is stationary or running.

In all of the above-described embodiments, the mill can be oriented vertically as shown in the drawings or at any angle desired for any given situation with any modifications necessary to feed the material in and remove the finished product.

The mill design with its concentric shafts 3 and 6 and counter rotating rotor arrangement lends itself to a level of precision operation that provides a high degree of versatility noted as follows:

a. The mill can grind coal as well as other ores such as gold and copper, to name a few, and grind them finer more efficiently than current state of the art mills.

b. The mill with appropriately designed milling heads can efficiently reduce biomass materials such as wood chips, pecan shells, switch grass, willow sprouts, etc. for fuel.

c. The mill can be fitted with rotor head designs that can de-water saturated materials to the point that with the increased surface area produced by the size reduction, the heat resulting from the work done in grinding and the introduction of heated air for transport very wet materials can be efficiently ground down to specification sizes.

d. The high speed rotor operation design makes possible the addition of a very simple centrifuging system that is an extension to the grinding means that can be used to remove ash waste materials from the coal.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A mill comprising:

first and second motors;

counter-rotating first and second rotors driven by the first and second motors, respectively;

a hollow shaft connecting the first motor to the first rotor; and a solid shaft connecting the second motor to the second rotor, the solid shaft running inside the hollow shaft;

wherein the first and second motors, the first and second rotors, and the hollow and solid shafts form a package of dual counter-rotating rotor centrifugal devices; and wherein the mill has a structure arranged to permit quick and easy insertion and removal of the package.

2. The mill of claim 1, further comprising locking devices for locking the package in place.

3. The mill of claim 2, wherein the locking devices are hydraulically operated.

4. The mill of claim 2, further comprising an air plenum surrounding the package, wherein the air plenum directs transport air along paths necessary to the successful operation of the mill.

5. The mill of claim 4, wherein the air also directs cooling air along paths necessary to the successful operation of the mill.

6. The mill of claim 4, further comprising:

a structure into which the package and the air plenum are assembled, the structure completing the mill by providing support for the package and the air plenum;

first connection means for bringing unground material to the mill;

second connection means for supplying process air to the mill;

third connection means for conducting finished product from the mill; and fourth connection means for connecting electrical and hydraulic services to the mill.

7. The mill of claim 1, wherein the first and second rotors have outer rings configured to directly crush any oversize particles as they exit the first and second rotors, whereby the outer rings act as a product size-limiting device.

8. The mill of claim 7, wherein the outer rings have a sizing gap therebetween; and wherein the mill further comprises means for adjusting the sizing gap by moving the shafts axially relative to each other.

9. The mill of claim 8, wherein the adjusting means can be operated manually while the mill is stationary.

10. The mill of claim 8, wherein the adjusting means can be operated manually while the mill is running.

11. The mill of claim 8, wherein the adjusting means can be operated automatically while the mill is stationary.

12. The mill of claim 8, wherein the adjusting means can be operated automatically while the mill is running.

13. The mill of claim 1, wherein the mill is oriented vertically.

14. The mill of claim 1, wherein the mill is oriented at an angle.

15. The mill of claim 1, wherein the rotors are configured for cutting and shredding biomass materials.

* * * * *